United States Patent [19]

Kronberger et al.

[11] Patent Number: 4,960,241

[45] Date of Patent: Oct. 2, 1990

[54] DIESEL ENGINE PUMP NOZZLE HAVING A CONTROL SLEEVE

[75] Inventors: Maximilian Kronberger; Eugen Drummer, both of Steyr, Austria

[73] Assignee: Voest-Alpine Automotive Gesellschaft m.b.H., Linz, Austria

[21] Appl. No.: 332,722

[22] Filed: Apr. 4, 1989

[30] Foreign Application Priority Data

Apr. 8, 1988 [DE] Fed. Rep. of Germany ..... 3811846

[51] Int. Cl.[5] ..... F02M 47/02; F04B 39/10

[52] U.S. Cl. ..... 239/90; 239/91; 239/95; 417/494; 417/499; 123/502

[58] Field of Search ..... 123/502; 239/88–93, 239/95; 417/499, 494

[56] References Cited

U.S. PATENT DOCUMENTS

| | | | |
|---|---|---|---|
| 2,118,578 | 5/1938 | Trapp . | |
| 2,740,667 | 4/1956 | Dickson et al. | 239/90 |
| 3,999,529 | 12/1976 | Davis . | |
| 4,108,130 | 8/1978 | Bailey | 123/502 |
| 4,630,587 | 12/1986 | Höfer et al. | 123/502 |

FOREIGN PATENT DOCUMENTS

| | | |
|---|---|---|
| 3143073 | 5/1983 | Fed. Rep. of Germany . |
| 3428174 | 2/1986 | Fed. Rep. of Germany . |

*Primary Examiner*—Leonard E. Smith
*Assistant Examiner*—John A. Savio, III
*Attorney, Agent, or Firm*—Cushman, Darby & Cushman

[57] ABSTRACT

A pump nozzle for a diesel engine, in which an injection pump element including a pump piston driven by a cam-shaft and a bushing is combined with an injection nozzle to a unit provide be associated with a motor cylinder. The pump piston is surrounded by an axially shiftable control sleeve controlling the begin of fuel injection in dependence on its axial position. A regulating member is guided on the pump element body for rotation relative to the control sleeve in dependence on an operating parameter of the motor. The control sleeve or the regulating member has a race which has, as seen in a top plan view, a circular shape and including with a normal plane extending in normal relation to the pump piston at least partially a pitch angle. A guide element which is rigidly connected with the respective other part (i.e. the regulating member or the control sleeve cooperates with this race. By the cooperation of this guide element with the race, the control sleeve is, during the relative rotation, lifted or lowered and the beginning of fuel injection is controlled. The race may also have in mutually succeeding sections angles of inclination of different size and/or of different orientation.

16 Claims, 9 Drawing Sheets

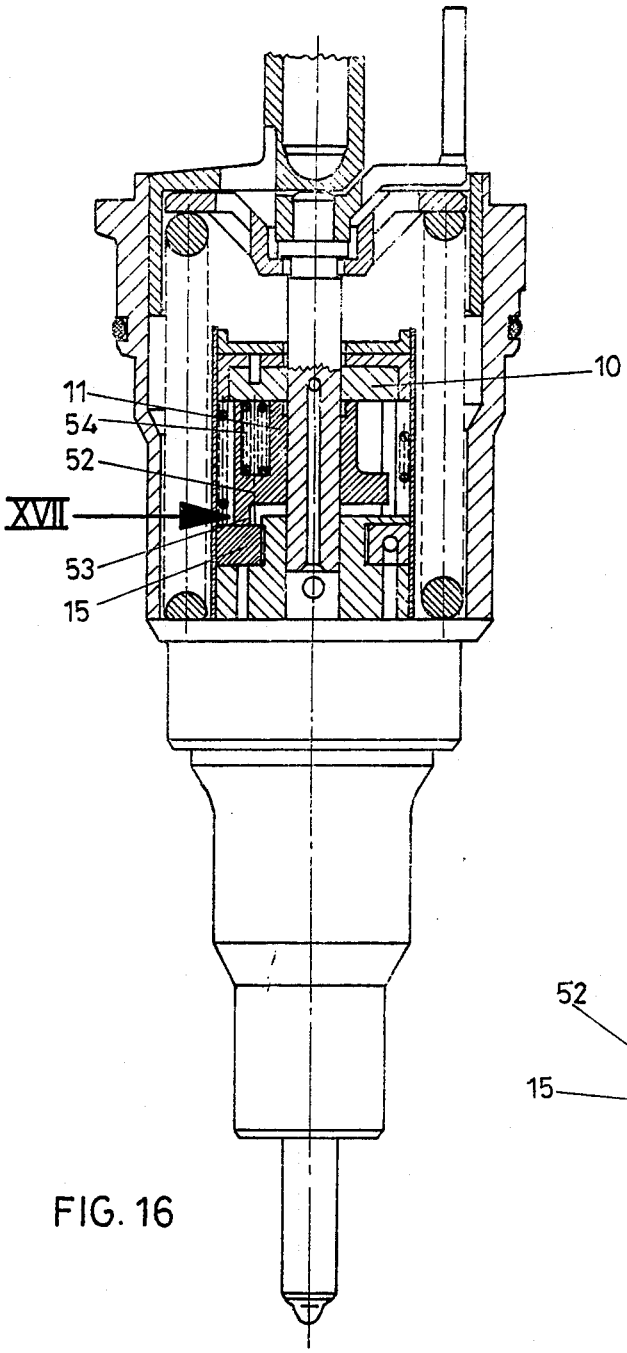
FIG. 16
FIG. 17
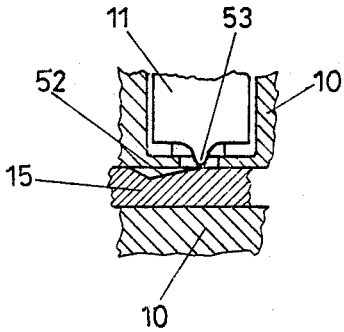

DIESEL ENGINE PUMP NOZZLE HAVING A CONTROL SLEEVE

BACKGROUND OF THE INVENTION

1. Field of the Invention

The invention relates to a pump nozzle for diesel engine, in which an injection pump element comprising a pump piston driven by a cam-shaft and a bushing is combined with an injection nozzle to provide with a unit to be associated to one motor cylinder. The pump piston is surrounded by a control sleeve which is adjustable by an adjusting force in direction of the axis of the pump piston in dependence on operating parameters of the motor for the purpose of varying the beginning of the injection. The pump piston can be rotated relative to the control sleeve for the purpose of adjusting the supplied fuel amount. The control sleeve or a part connected therewith is guided in a manner preventing rotation relative to the pump element body. Such a control sleeve has, as a rule, a control edge located within a plane extending normal to the pump axis and controlling the beginning of fuel injection. An obliquely extending control edge of the control sleeve or of the pump piston defines the end of injection and thus the injected amount of fuel in dependence on the rotated position of the pump piston relative to the control sleeve. By adjusting the height position of the control sleeve, the control edge defining the beginning of injection is earlier or later slid past the control bore of the piston, so that the beginning of supply by the injection pump is adjusted.

2. Description of the Prior Art

From DE-OS 31 43 073, there has become known a pump nozzle of the type in which the control sleeve is axially adjustable for the purpose of adjusting the beginning of injection. In this case, adjusting of the control sleeve is directly effected by means of a hydraulic piston. On account of adjusting the control sleeve directly by means of the hydraulic piston, the adjusting path of the control sleeve is equal to the adjusting path of the hydraulic piston. On account of the adjusting path of the control sleeve being small, there are at disposal only small adjusting paths of the hydraulic piston for adjusting the control sleeve, so that such a control is not delicately sensitive and precise. In an embodiment according to the mentioned DE-OS, the hydraulic piston is connected with the control sleeve via a linkage. Adjusting of the control sleeve becomes inprecise also on account of the play within the linkage. The control sleeve is immediately guided on the pump piston, so that wear is promoted between control sleeve and pump piston. The control piston is guided on the pump piston over a comparatively small guide length, so that there exists the risk for the control sleeve to become jammed on the pump piston, thereby increasing the wear of pump piston and control sleeve and reducing the precision of control. In another embodiment, the axially adjustable hydraulic piston surrounds the pump piston and is itself designed as the control sleeve. Also in this embodiment, the adjusting path of the hydraulic piston is thus equal to the adjusting path of the control sleeve, and there are additionally required sealings which equally detract from the precision and the sensitiveness of the control on account of the friction phenomenon.

SUMMARY OF THE INVENTION

It is an object of the invention to provide a pump nozzle in which the beginning of injection can exactly be adjusted in a reproducible manner individually and independent from the pump nozzles for other cylinders of the motor and in a precise and delicately sensitive manner and can be adapted to various operating parameters of the motor. The adjusting device is also suitable for electronic operation.

For solving this task, the invention provides apparatus in which a regulating member, which can be rotated around the axis of the pump piston, is supported on the pump element body in an axially non-shiftable manner and for being rotatable relative to the control sleeve or, relative to the part connected therewith and has acting thereon the adjusting force. One of the parts is rotatable relative to the other—i.e. the control sleeve and, respectively, the part connected therewith and the regulating member—is provided with at least one race having, as seen in an axial projection, an approximately circular shape and surrounding the axis of the pump piston and including over at least part of its length with a normal plane relative to the axis of the pump piston a pitch angle, while the other of these parts has a guide element cooperating with the race. The race may be arranged on the control sleeve or on a part connected therewith. The regulating member carries the guide element cooperating with the race. However, it is also possible that the control sleeve or the part connected therewith carries the guide element and that the regulating member comprises the race. On account of the control sleeve or the part connected therewith being guided on the pump element body in axially shiftable manner and in a manner secured against rotation and on account of the regulating member being rotatably supported on the pump element body in a manner secured against axial shifting movement, relative rotation of both components results in both cases in lifting or lowering the control sleeve and thus in varying the beginning of fuel injection. On account of the race having, as seen in an axial projection, a substantially circular shape, the guide element is in all relative rotated positions in permanent contact with the race. The cooperation of the guide element with the race results in a transformation of the rotating movement of the regulating member into a shifting movement of the control sleeve. The degree of such transformation is dependent on the magnitude of the angle of inclination included between the race and the normal plane extending in normal relation to the axis. On account of such transformation, the precision and sensitiveness of changing the beginning of fuel supply can be increased. According to the invention, the race may, for example, include a pitch angle of 0° to 80° with a plane extending in normal relation to the axis of the pump piston.

According to the invention, the race can, for example, be a screw surface extending along a helical line. In this case, the transmission ratio remains the same over the whole rotating area of the regulating member and the lifting path of the control sleeve is proportional to the rotating angle of the regulating member. According to the invention, the race may, however, also comprise sections, arranged one behind the other, having inclinations of different size, and/or different directions. The pitch angle may be zero at certain locations of the race. In this case, it is possible to adapt the begin of fuel supply to most differing conditions.

In this case and according to the invention, the one part may comprise a groove delimited by two races extending in parallel relation. The guide element is given a hook-like shape and positively engages the groove with its hook portion. However, the one part may also comprise a web which is delimited by two parallelly extending races. The guiding element is designed as a claw embracing the web in a form-locking manner. In both of these cases, one has to accept a play depending on the production accuracy and possibly detracting from the precision of the adjustment. However, the control sleeve may, according to the invention, also be loaded by a force acting in axial direction, in particular by a spring, which maintains the race in contact with the guide element. In this case, any play in the transmission is avoided by the resilient contact. Such a race can, for example, be formed at the lower edge of the control sleeve. This race is sensed by a correspondingly shaped guide element of the regulating member. The means preventing any rotation of the control sleeve relative to the stationary pump element body can be formed by a simple sliding guide, for example by a rod which is connected with the pump element body. However, the means preventing rotation of the control sleeve can, according to the invention, also be formed by a ball guide, the balls of which are arranged between axially parallel surfaces of the control sleeve and of the pump element body. Such an arrangement has advantages, because the easily movable guide means facilitates the axial adjustment of the control sleeve by the guide element sensing the race and because friction forces are substantially avoided, which might detract from the precision of the adjustment.

The regulating member, which is rotatable around the axis of the pump piston, can, for example, be formed by the rotor of an electrical control member or be connected therewith. However, the regulating member is, according to a preferred embodiment of the invention, formed of a control piston having the shape of an annular segment and being sealingly guided in an annular groove, which is tightly closed by an outer bushing or the like, of the pump element body and being adapted to be subjected to the action of a hydraulic fluid against a restoring force, in particular a spring force. Such an arrangement can be adjusted in a simple and precise manner. In this case and according to the invention, the annular groove can, for the purpose of providing a working chamber for the control piston having the shape of an annular segment, be closed at one location by a portion of the pump element body or by a part connected therewith. In this case and according to the invention, there can be provided a spring chamber for a restoring compression spring within the groove at that side of the part closing the groove which is located opposite the working chamber, the return spring being supported against the part closing the groove and against the control piston having the shape of an annular segment. The return spring can, however, also be a torque spring which is supported against the pump element body and against the control piston having the shape of an annular segment. In this case and according to the invention, the torque spring is conveniently supported against an adjusting disc or like adjusting element which is rotatably connected with the pump element body and which is adapted to be locked in its rotated position. This provides the possibility of adjusting the pre-stress of the torsion spring forming the return spring in accordance to the requirements. In a constructional embodiment of the invention, there can be connected with this adjusting disc or the like a pin which can selectively be inserted in a plurality of relatively staggered bores of the pump element body which provides the possibility of adjusting the spring tension in a simple manner when assembling the pump.

If the ring piston segment is hydraulically adjusted, the arrangement may, according to an advantageous embodiment of the invention, be such that the control piston having the shape of an annular segment is subjected to the action of fuel contained within a pressure-controlled chamber, in which the pressure is controlled in dependence on operating parameters of the motor, for example by a valve controlled by an electronic means, in particular by a switching valve. The fuel may be supplied into the pressure-controlled chamber by a separate pump or optionally also from the suction chamber or from the fuel discharge chamber of the pump nozzle.

Adjustment of the height position of the control sleeve and thus of the begin of fuel injection shall, as far as possible, not be disturbed by interference vectors. In such pump nozzles, the fuel is, as a rule, discharged into the suction chamber of the pump nozzle. This results in pressure shocks within the suction chamber, which pressure shocks become effective until the guide element cooperating with the race and thus detract from the precision. On account thereof and according to the invention, the fuel discharge chamber is separated from the suction chamber and is connected via bores with a return conduit.

BRIEF DESCRIPTION OF THE DRAWING

In the drawing, the invention is schematically illustrated with reference to examples of embodiment.

FIG. 1 shows an axial section along line I—I of FIG. 2 and FIG. 2 shows a section along line II—II of FIG. 1.

FIG. 4 represents a partial section corresponding to FIG. 5 and FIG. 5 shows a view in direction of the arrow V of FIG. 4.

FIG. 11 shows a section along line XI—XI of FIG. 10 and FIG. 10 shows a view in direction of the arrow X of FIG. 11.

FIG. 13 represents a view in direction of the arrow XIII of FIG. 12.

FIG. 15 shows a view in direction of the arrow XV of FIG. 14.

FIGS. 16 and 17 show another modified embodiment. FIG. 16 shows a partial axial section through the pump nozzle and FIG. 17 shows a view in direction of the arrow XVII of FIG. 16.

DETAILED DESCRIPTION OF THE PREFERRED EMBODIMENTS

Figure 1:
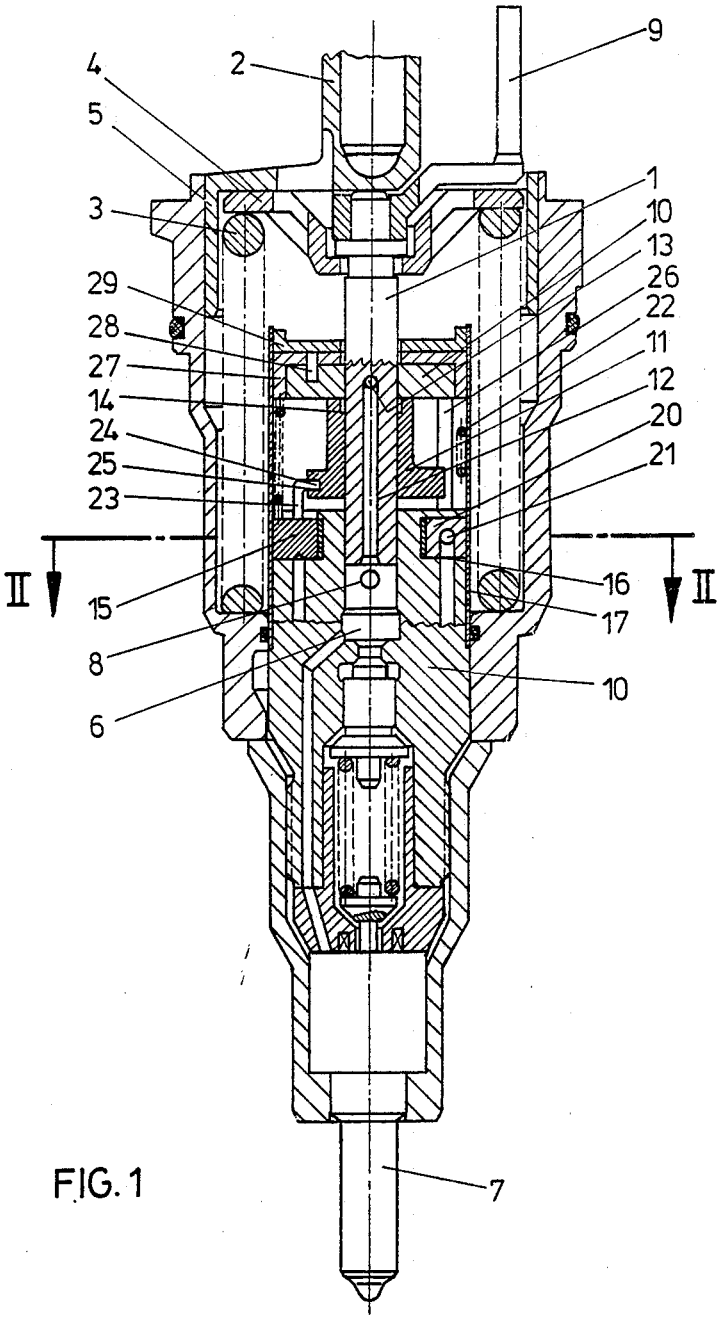
FIGS. 1 and 2 show an embodiment of the pump nozzle.
Figure 2:
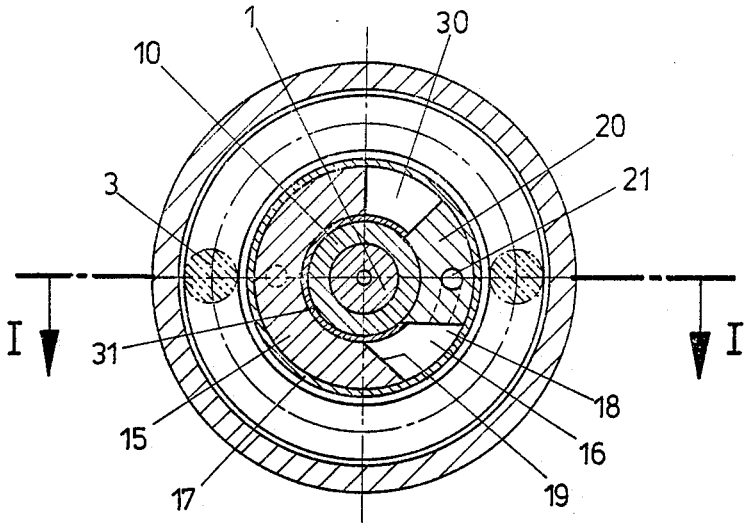

In the embodiment according to FIGS. 1 and 2, reference numeral 1 represents the pump piston, which is driven by a cam shaft, not shown, via a rocker lever and a push rod 2. The return spring 3 of the pump piston acts on the pump piston 1 via a spring washer 4 and is guided within a guide bushing 5. 6 is the high-pressure chamber of the pump and 7 is the injection nozzle. 8 is the suction bore. 9 is a crank lever for rotating the piston for the purpose of adjusting the supplied fuel amount. 10 is the pump element body.

11 is the control bushing, which surrounds the pump piston 1 and comprises the control bores and control edges, respectively. The piston 1 has an axial bore 12 from which extends a radial bore 13. If the control edge 14 of the control sleeve 11 closes the radial bore 13, fuel supply is started. As soon as the oblique edge (not shown) of the control sleeve 11 clears the transverse bore 13 of the piston 1, the supply stroke is finished and the fuel is discharged from the high-pressure chamber 6.

15 is a regulating member which is guided within a groove 16 of the pump element body 10 for being rotated around the axis of the pump piston 1, the regulating member being designed as a piston 15 having the shape of an annular segment. The annular groove 16 is tightly closed by an outer bushing 17 surrounding the pump element body 10, so that a working chamber 18 is formed which is delimited by a front surface of the piston 15 having the shape of an annular segment and by a part 20 which is rigidly connected with the pump element body 10. Hydraulic fluid is supplied under a controlled pressure into said working chamber 18 via a bore 21 within the part 10, so that the piston 15 having the shape of an annular segment can be rotated within the annular groove 16 of the pump element body 10 under the pressure of the hydraulic fluid. 22 is a torque spring acting on the piston 15 and supported against the pump element body 10. The hydraulic fluid acts within the working chamber 18 against the pre-stress of the torsion spring 22, so that this torsion spring 22 represents a return spring for the piston 15 having the shape of an annular segment.

A guide element 23 having a hook-like shape is connected with the piston 15 having the shape of an annular segment. The hook of this guide element 23 is engaged within an annular groove 24 being provided on the circumference of the control sleeve 11 and being delimited by parallel races 25. The races are in the embodiment according to the drawing, formed of screw surfaces extending along a helical line. The control sleeve 11 itself is in its turn secured against rotation by means of a guide pin 26 inserted into the control sleeve 11 and rigidly connected with the pump element body 10. By rotating the piston 15, which has the shape of an annular segment, the control sleeve is, via the guide element 23, lifted and lowered, so that the begin of fuel injection is varied in dependence on the hydraulic pressure which has been made effective within the working chamber 18.

The outer bushing 17 is rigidly connected with the pump element body 10. 27 is an adjusting disc, against which the torsion spring 22 is supported. The pump element body 10 has at its upper end bores (not shown) which are arranged at a distance one from the other along an arc of a circle. A pin 28 connected with the adjusting disc 27 can selectively be inserted into the bores. During assembling, the adjusting disc 27 can thus be fixed in different rotated positions relative to the pump element body 10, so that the pre-tension of the torsion spring 22 can in this manner be adjusted to differing values. 29 is a threaded ring, which can be screwed into the outer bushing 17 and which holds the adjusting disc 27 in its position.

30 is a free space located within the annular groove 16 and allowing rotation of the piston 15, which has the shape of an annular segment. 31 is a slotted sealing ring inserted between the bottom of the annular groove 16 and the piston 15.

Figure 3:
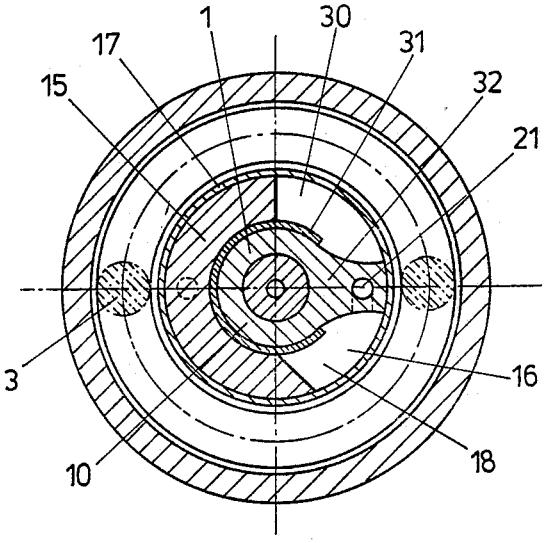
FIG. 3 shows, in the same manner as FIG. 2, a cross-section through a modified embodiment.

The embodiment according to FIG. 3 differs from the embodiment according to FIG. 2 in that the part 32 closing the annular groove forms an integral part with the pump element body 10, while the part 20 is, according to FIG. 2, a separate part rigidly connected with the pump element body 10.

Figure 4:
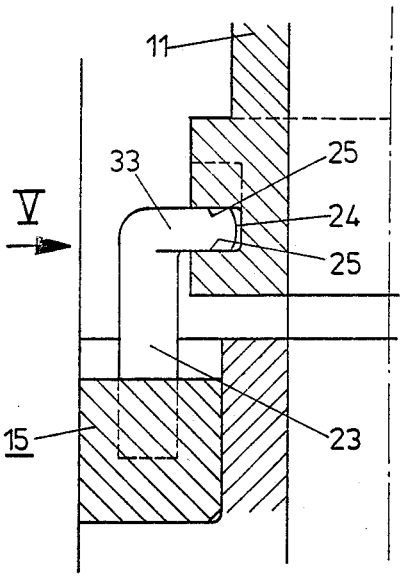
FIGS. 4 and 5 show a detail.
Figure 5:
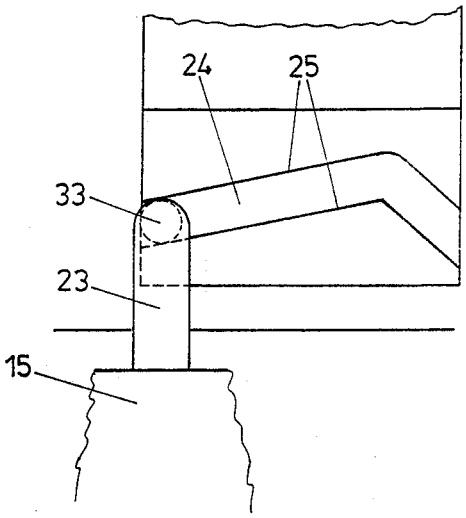

FIGS. 4 and 5 show in a greater scale the detail of the piston 15 together with the guide element 23 and the lower portion of the control sleeve 11. The guide element 23 has a hook 33 engaging the groove 24 being delimited by the races 25. In FIG. 5 it is shown, that the helical line along which extends the groove 24 may also have a kinked shape, which might be convenient for certain control problems.

Figure 6:
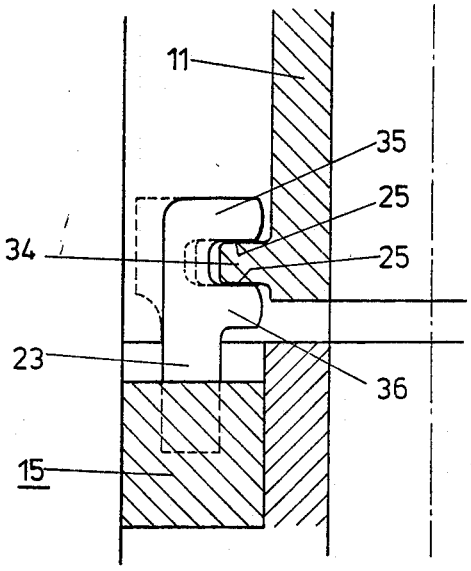
FIG. 6 shows a modified embodiment in a partial section corresponding to FIG. 1.

FIG. 6 shows an embodiment, in which there is provided on the control sleeve 11, in place of the groove 24, a web 34 extending along a helical line and being delimited by the races 25. In this case, the guide element 23 is equipped with two claws 35 and 36 embracing the web 34.

Figure 7:
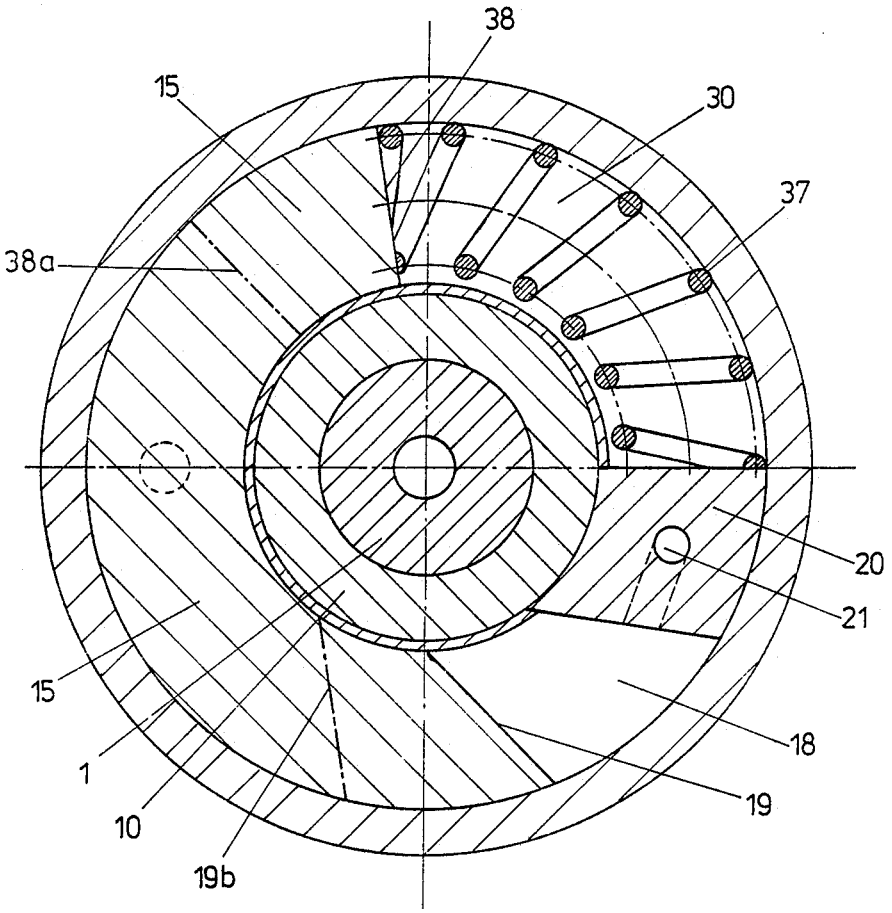
FIG. 7 shows in a greater scale a modified embodiment in a section along line II—II of FIG. 1.

The embodiment according to FIG. 7 differs from the embodiment according to FIG. 2 in that a bent helical compression spring 37 is inserted into the chamber 30 in place of the torsion spring 22. The helical compression spring 37 is supported against the part 20 which is rigidly connected with the pump element body 10 and acts on the end surface 38 of the control piston 15 which has the shape of an annular segment, in opposite direction to the hydraulic pressure existing within the working chamber 18 and acting on the piston surface 19. The maximum position and the minimum position of the piston 15 are indicated by the reference numerals 19*b* and 38*a*. At the lowest pressure within the working chamber 18, the end surface 38 arrives at the position 38*a*, while under maximum pressure within the working chamber 18, the piston surface 19 arrives at the position 19*b*.

Figure 8:
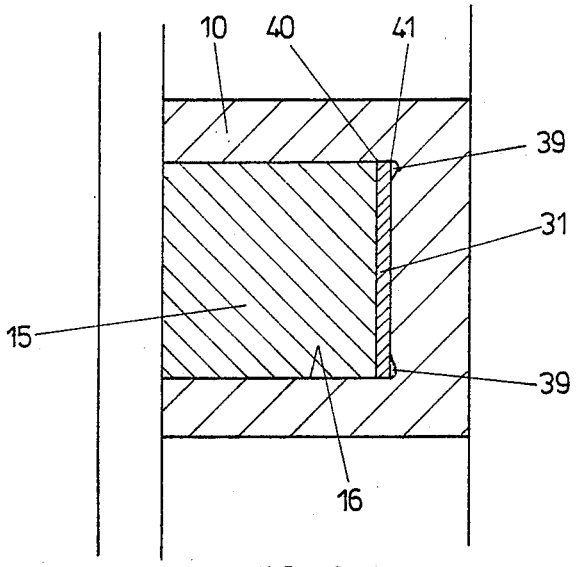
FIGS. 8 and 9 show two modified embodiments in partial sections extending through the axis of the pump nozzle.

FIG. 8 shows the sealing ring 31 between the annular groove 16 and the piston 15 in case of an arrangement, in which the annular groove 16 is provided with reliefs 39. In this case, it is essential that the sealing ring 31 have sharp edges 40 and 41. By means of these sharp edges, leakage is reduced to an acceptable degree.

Figure 9:
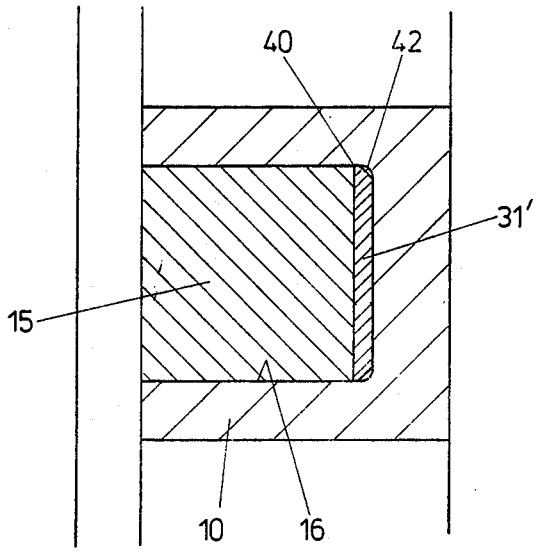

FIG. 9 shows an embodiment in which the annular groove 16 has no reliefs 39. The sealing ring 31' is provided at its rear side with chamfers 42, while the sharp edge 40 is maintained.

In both cases, this sealing ring 31 or 31' may consist of metal, for example, steel. Only sharp edges 40 and 41 are essential. These sealing rings 31 and 31' are of slotted design, so that they can be inserted into the annular groove 16. For sealing purposes, the slot is arranged where the part 20 closes the annular groove, or is given such a width that the sealing ring keeps free the part 32 (FIG. 3).

Figure 10:
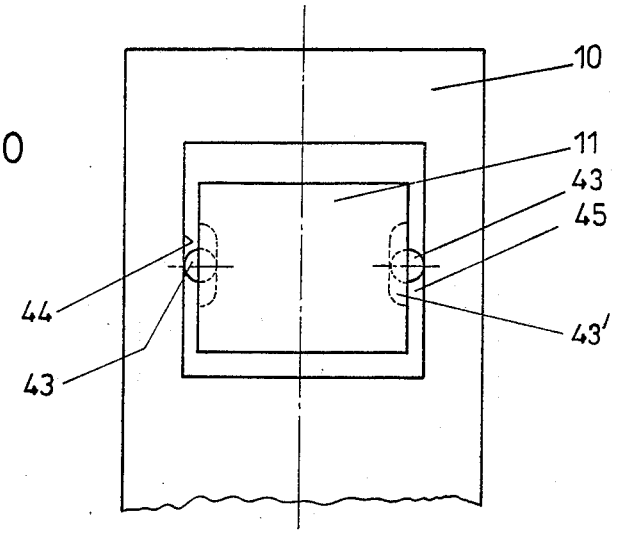
FIGS. 10 and 11 show in a schematic representation a modified embodiment of the means for preventing rotation of the control sleeve.
Figure 11:
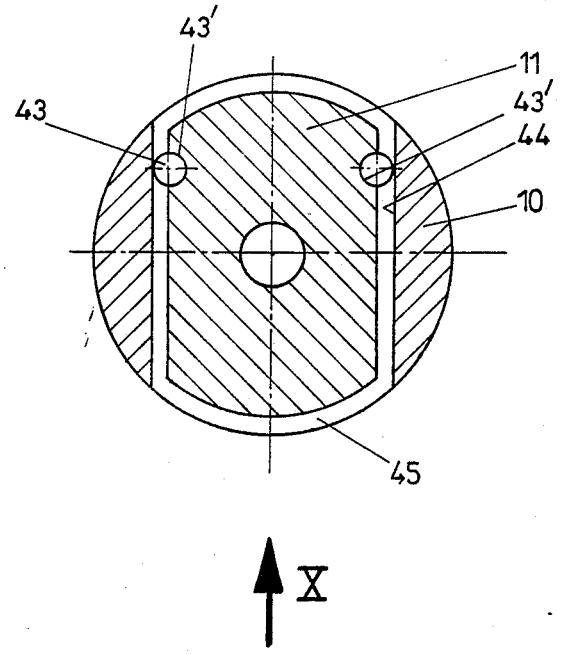

In the embodiment according to FIGS. 10 and 11, the control sleeve 11 is guided by balls 43 along axially parallel surfaces 44 of the pump element body 10, the balls 43 running in grooves 43' of the control sleeve 11. 45 is the fuel discharge chamber. By means of this ball guide, axial shifting movement of the control sleeve 11 is facilitated, so that control becomes more sensitive.

Figure 12:
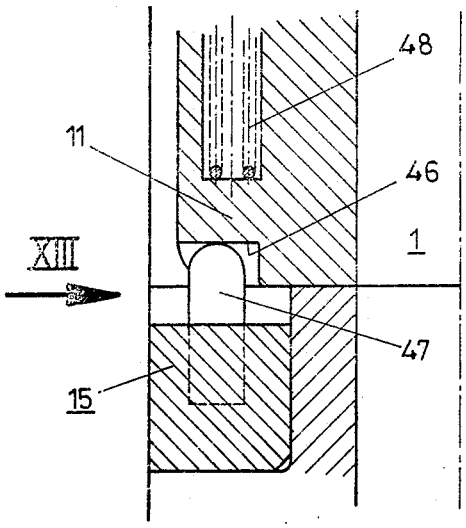
FIGS. 12 and 13 show a modified embodiment in a partial section within the area of the control sleeve.
Figure 13:
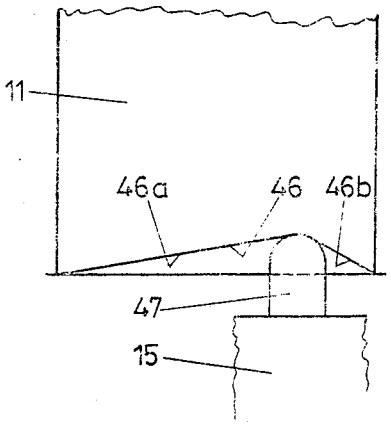

FIGS. 12 and 13 show in a partial view within the area of the control sleeve, a modified embodiment, in which the circular race 46 having, as seen in an axial projection, substantially circular shape, is arranged on the bottom side of the control sleeve 11 and cooperates with a guide element 47 which is arranged on the piston 15 which has the shape of an annular segment. In this case, the control sleeve 11 is maintained in contact on the guide element 47 by a compression spring 48. In this example it is shown how two sections **46*a* and 46*b* of differing pitch angle and of differing orientation are arranged one behind the other on the race 46**.

Figure 14:
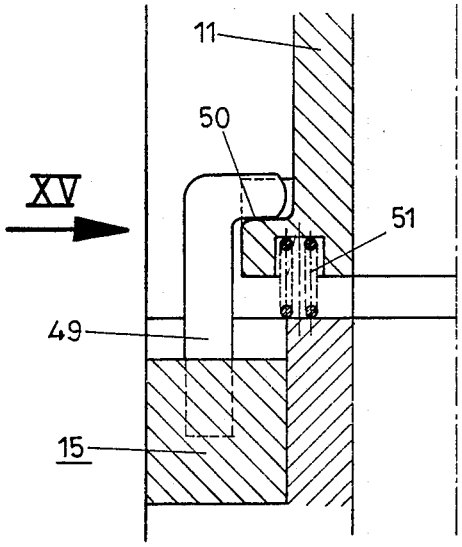
FIGS. 14 and 15 show another modified embodiment in a partial section within the area of the control sleeve.
Figure 15:
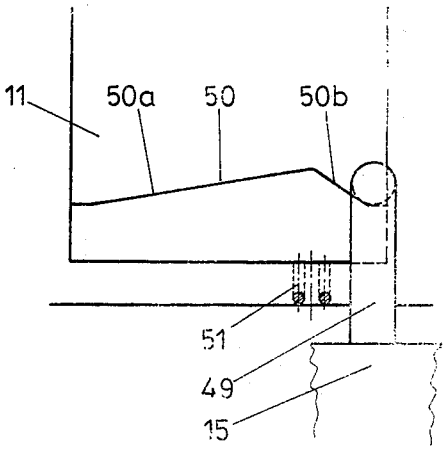

In a modified embodiment according to FIGS. 14 and 15, the guide element 49 is hook-like in shape and cooperates with a race 50 which is provided on the control sleeve 11. In this case, the control sleeve 11 is pressed in upward direction by means of compression springs 51, so that the race 50 is, in a force-locking manner, maintained in contact on the guide element 49. The race 50 is, here again, subdivided into sections **50*a* and 50*b*** having differing pitch angles and differing orientations and which are arranged one behind the other.

FIGS. 16 and 17 show an example of embodiment in which, in contrast to FIG. 1, the race 52 has, as seen in axial projection, substantially circular shape, is arranged on the regulating member being formed of the piston 15 and the guide element 53 is arranged on the control sleeve 11. The guide element 53 consists of a nose cooperating with the race 52. The control sleeve 11 is pressed in a downward direction by compression springs 54, which are supported against the pump element body 10, so that the guide element or, respectively, nose 53 is held in contact on the race 52 by these compression springs.

Figure 18:
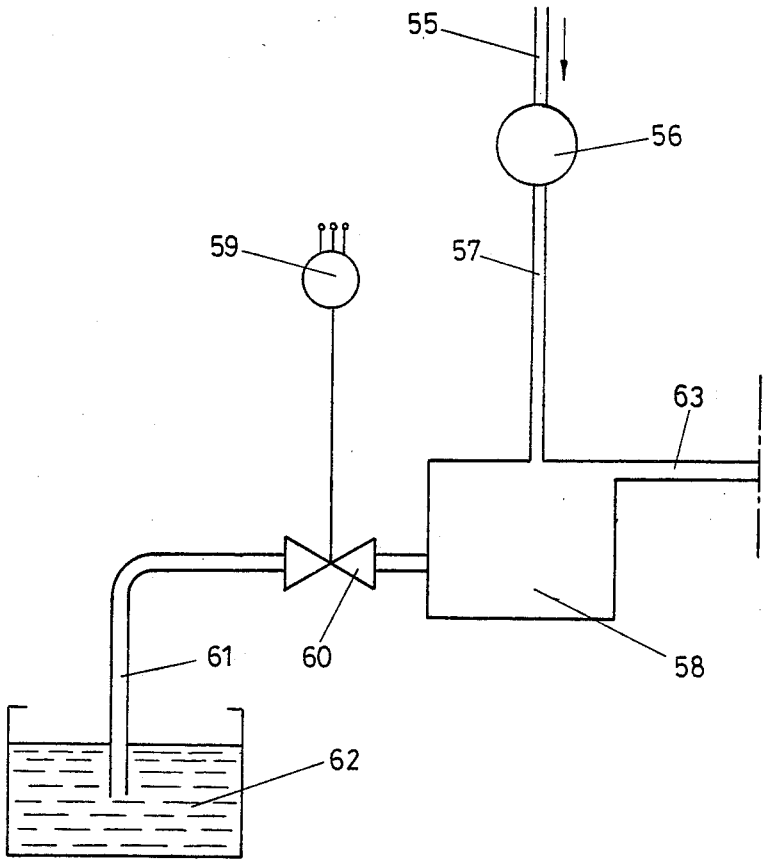
FIG. 18 schematically illustrates the manner of regulating the pressure of the hydraulic fluid acting on the ring segment piston.

FIG. 18 schematically illustrates a possibility for regulating the pressure of the hydraulic fluid which is fed into the working chamber 18 of the piston 15. By means of a pump 56 which is supplied with fuel via a conduit 55, the fuel is fed into a chamber 58 via a conduit 57. This chamber 58 is connected with a return flow conduit 61 leading to the fuel tank 62 via a switching valve 60 which is controlled by an electronic regulator 59. By means of this electronically controlled valve, the pressure within the chamber 58 is controlled in correspondence with operating parameters of the motor. From this pressure-controlled chamber 58, the pressure-controlled fuel flows via a conduit 63 into the working chamber 18 of the piston 15.

What is claimed is:

1. A diesel engine pump nozzle, comprising:

a housing having an inlet for fuel, and a normally closed, intermittently openable valved injunction nozzle for delivering fuel to a cylinder of a diesel engine;

a pump element body received in the housing between the fuel inlet and the valved injection nozzle, said pump element body having a longitudinal axis;

means defining a pump piston chamber extending coaxially in said pump element body from an outer end of said pump element body;

said pump piston chamber having a suction bore communicated with said fuel inlet and a fuel delivery passageway communicated with said valved injection nozzle;

a pump piston longitudinally slidingly received in said pump piston chamber and having a protruding outer end arranged to be intermittently pushed axially inwards by a diesel engine cam shaft sufficiently for causing fuel which has been drawn into said pump piston chamber through said suction bore, to be forced out of said pump piston chamber through said fuel delivery passageway for being injected into a diesel engine cylinder through said valved injection nozzle;

spring means provided between the pump piston and the housing for returning said pump piston axially outwardly each time after said pump piston has been pushed axially inwards;

a control sleeve disposed in said pump element body in circumferentially surrounding relation to said pump piston;

means for axially adjusting positioning of said control sleeve relative to said pump element body in dependence on at least one diesel engine operating parameter for varying when, in a given cycle of fuel injection, injection of fuel begins through said valved injection nozzle in relation to the extent to which said pump piston has been pushed downwards by a diesel engine cam shaft;

said pump piston being rotatable about said longitudinal axis, relative to said control sleeve, for adjusting how much fuel, in a given cycle, is injected through said valved injection nozzle;

means provided between said control sleeve and said pump element body for preventing rotation of said control sleeve relative to said pump element body;

a regulating member received within said housing and supported on said pump element body for angular rotation about said longitudinal axis, relative to said control sleeve;

means preventing substantial axial movement of said regulating member relative to said pump element body;

adjustable spring means acting between said control sleeve and said regulating member angularly of said longitudinal axis and tending to maintain said regulating member in, and restore said regulating member to a given angular position relative to said control sleeve, about said longitudinal axis;

one of said control sleeve and said regulating member being provided with at least one race which is approximately circularly arcuate in transverse cross-sectional shape and centered on said longitudinal axis, said race having throughout at least a segment of the length thereof a pitch angle relative to a normal plane which extends normal to said longitudinal axis; and the other of said control sleeve and regulating member having a guide element which engagingly cooperates with said race, so that as the regulating member and control sleeve are relatively rotated about said longitudinal axis, the control sleeve is axially moved relative to the pump piston; and means for adjustably forcibly rotating said regulating member and control sleeve against restoration force provided by said adjustable torsion spring means.

2. The pump nozzle of claim 1, wherein:
said pitch angle of said race is a maximum of 80 degrees.

3. The pump nozzle of claim 2, wherein:
said race is helically curved about said longitudinal axis.

4. The pump nozzle of claim 1, wherein:
said race has a plurality of segments having different pitch angles relative to said normal plane.

5. The pump nozzle of claim 1, wherein:
said race is provided as axially opposite sides of a groove and said guide element is provided as a hook which is received in said groove for engagement with said sides.

6. The pump nozzle of claim 1, wherein:
said race is provided as a radially outwardly projecting web and said guide element is provided as a claw which embraces said web in a form-following manner.

7. The pump nozzle of claim 1, further including:
a spring acting axially against said control sleeve for maintaining said race in contact with said guide element.

8. The pump nozzle of claim 1, wherein:
said means for preventing rotation of said control sleeve relative to said pump element body comprises a ball guide having a plurality of balls arranged between axially parallel surfaces respectively provided on the control sleeve and the pump element body.

9. The pump nozzle of claim 1, wherein:
said regulating member is constituted by a piston shaped as a segment of an annulus, said piston being sealingly, angularly slidably received in an annular groove in said pump element body;
said annular groove being at least partly tightly closed by a radially outer bushing for providing a working chamber for said segment-shaped piston;
said working chamber having an end provided in said annular groove;
said means for adjustably forcibly rotating said regulating member comprises means for applying hydraulic pressure to an end of said segment-shaped piston.

10. The pump nozzle of claim 9, wherein:
a portion of said pump element body forms a corresponding portion of said working chamber for said segment-shaped piston.

11. The pump nozzle of claim 9, wherein:
said adjustable spring means is constituted by a compression spring mounted between an end of said segment-shaped piston and an end of said working chamber.

12. The pump nozzle of claim 9, wherein:
said adjustable spring means is constituted by a torsion spring supported between the pump element body and said segment-shaped piston.

13. The pump nozzle of claim 12, further including:
a rotatable, position-lockable adjusting disk interposed between said torsion spring and said pump element body for adjusting force applied said segment-shaped piston by said torsion spring.

14. The pump nozzle of claim 13, wherein:
one of said disk and said pump element body is provided with an axially projecting pin and the other of said disk and said pump element body is provided with a plurality of bores spaced angularly from one another about said longitudinal axis for selectively receiving said pin, for adjustably position-locking said disk.

15. The pump nozzle of claim 9, further comprising:
a C-shaped sealing ring received in said annular groove so as to be interrupted at said end wall of said working chamber, said sealing ring being arranged radially between said segment-shaped piston and a radially inner wall of said annular groove.

16. The pump nozzle of claim 9, further including:
means for applying fuel which is pressurized to a variable pressure depending on operating conditions of a diesel engine, to said working chamber, as a working fluid for acting on said segment-shaped piston.

* * * * *